United States Patent [19]

Kostanecki et al.

[11] 4,414,714

[45] Nov. 15, 1983

[54] EXPANSIBLE CLASP AND MODULE FOR WATCH STRAPS

[75] Inventors: Andrew T. Kostanecki, Darien, Conn.; George Mileos, Riverdale, N.Y.

[73] Assignee: Timex Corporation, Waterbury, Conn.

[21] Appl. No.: 280,757

[22] Filed: Jul. 6, 1981

Related U.S. Application Data

[62] Division of Ser. No. 106,815, Dec. 26, 1979, abandoned.

[51] Int. Cl.[3] ..... A44C 5/18; A44C 11/02

[52] U.S. Cl. ..... 24/265 WS; 224/175

[58] Field of Search ..... 24/240, 241 R, 241 SL, 24/260, 265 EC, 265 H, 265 WS; 224/175, 176

[56] References Cited

U.S. PATENT DOCUMENTS

| | | | |
|---|---|---|---|
| 1,493,449 | 5/1924 | Person | 224/176 |
| 1,774,544 | 9/1930 | Barrowman | 224/176 X |
| 3,376,619 | 4/1968 | Brunet | 24/241 R |
| 3,557,412 | 1/1971 | Hauser | 24/241 R X |

FOREIGN PATENT DOCUMENTS

| | | | |
|---|---|---|---|
| 74371 | 2/1917 | Switzerland | 24/265 WS |
| 203202 | 5/1939 | Switzerland | 24/265 WS |

*Primary Examiner*—Robert P. Swiatek
*Attorney, Agent, or Firm*—William C. Crutcher

[57] ABSTRACT

Disclosed are expansible clasp and module constructions for connecting the free ends of a watch strap together while at the same time providing adequate expansion along the length of the strap to permit removal of the strap over the hand of the wearer without having to disconnect the free strap ends. The expansible clasp and module constructions employ one or more spring-biased sliding members disposed in a housing elongated along the strap length. In the clasp construction, the outer end of the sliding member effects releasable connection to one free strap end while one end of the housing is permanently attached to the other free strap end. The sliding member slides out of the housing against the spring bias in one direction along the strap length for expansion purposes during removal of the strap. In the module construction, a pair of superimposed sliding members is positioned in the housing with the outer end of each sliding member permanently attached to the adjacent free strap end at opposite ends of the housing. The sliding members slide out of the housing in opposite directions against the spring bias to provide for expansion in both directions along the length of the strap while the housing floats therebetween. Removal of the strap over the hand of the wearer without disconnecting the strap ends is thus greatly facilitated.

3 Claims, 7 Drawing Figures

EXPANSIBLE CLASP AND MODULE FOR WATCH STRAPS

This application is a division, of application Ser. No. 106,815, filed Dec. 26, 1979, and now abandoned.

FIELD OF INVENTION

The present invention relates to means for connecting the free ends of a strap, bracelet and the like together and for allowing the strap or bracelet to be passed over the hand of the wearer without disconnecting the strap ends. More particularly, the invention involves an expansible clasp or module for straps, bracelets and the like, especially wristwatch straps and bands.

DESCRIPTION OF THE PRIOR ART

Various clasp mechanisms have been devised by prior art workers for effecting connection between the free ends of a wristwatch strap while at the same time providing sufficient extension along the strap length, when needed, to remove the strap from the wearer's wrist without having to completely disconnect the strap ends.

One well-known type of clasp with limited extension for the aforesaid purpose comprises a buckle having two, three or more plates hinged together at their ends and foldable upon one another to effect engagement around the wearer's wrist and unfoldable to increase the length of the strap to the extent necessary to enable removal over the hand of the wearer. Illustrative of this buckle-type clasp are the Heilemann U.S. Pat. No. 1,778,455 issued Oct. 14, 1930; the Carlson U.S. Pat. No. 1,781,101 issued Nov. 11, 1930; the Weisman U.S. Pat. No. 1,785,059 issued Dec. 16, 1930; the Kestenman U.S. Pat. No. 1,809,278 issued June 9, 1931; the Johnson U.S. Pat. No. 1,835,496 issued Dec. 8, 1931; the Suttin U.S. Pat. No. 1,838,590 issued Dec. 29, 1931; the Eklund U.S. Pat. No. 2,082,621 issued June 1, 1937; the Frohlich U.S. Pat. No. 3,603,493 issued Sept. 7, 1971; the Ichinose U.S. Pat. No. 3,609,963 issued Oct. 5, 1971; the Mochizuki U.S. Pat. No. 3,797,716 issued Mar. 19, 1974; and the Omichi U.S. Pat. No. 4,000,542 issued Jan. 4, 1977. British Pat. Nos. 457,515 filed July 19, 1935; 457,791 filed June 5, 1935 and 476,631 filed June 9, 1936 also involve buckle-type clasps for wristwatch straps.

Another type of watch strap clasp or attachment employs spring-urged sliding members as shown in the Morelas U.S. Pat. No. 2,986,795 issued June 6, 1961, and the Rieth U.S. Pat. No. 3,609,962 issued Oct. 5, 1975, for example, FIGS. 7 and 8. A clasp utilizing a sliding zipper mechanism is illustrated in British patent No. 648,162 filed Feb. 10, 1949.

Still other clasp or attachment constructions for a watch strap are shown in French Pat. Nos. 495,714 filed May 12, 1950 and 1,069,906 filed Jan. 17, 1953.

SUMMARY OF INVENTION

The present invention provides an improved expansible clasp construction especially useful for connecting the free ends of a wristwatch strap or band together while at the same time providing adequate expansion in one direction along the strap length to permit removal of the strap or band over the hand of the wearer without having to disconnect the strap ends. Typically, the expansible clasp of the invention is permanently fastened to one of the free strap ends and releasably attached to the other.

The present invention also provides a novel expansible module permanently attached between the free strap ends to connect them together and capable of expansion in both directions along the strap length for greatly facilitating removal over the wearer'is wrist.

A typical expansible clasp of the present invention includes a housing enlongated in the long direction of the strap and having spaced ends transverse to the strap length with one of the ends defining an access opening into the housing and an abutment wall and the other end being connected to one of the free strap ends. Disposed in the housing and adapted to slide into and out of the housing through the end access opening is a sliding member having means at its outer end for releasably connecting to the other free strap end and having at its inner end an abutment wall in spaced, facing relation to the abutment wall of the housing end. Spring means such as a flat, Z-shaped spring is positioned in the housing between the spaced, facing abutment walls of the sliding member and housing with the spring being biased such that the sliding member is urged into the housing. However, the sliding member may be extended out of the housing along the length of the strap against the spring bias for expansion purposes.

In a preferred embodiment of the expansible clasp, the outer end of the sliding member includes an arcuate hook member hinged thereto, the hook member being adapted for insertion around a transverse lug on the adjacent free strap end to effect releasable engagement. In another preferred embodiment, the outer end of the sliding member includes a pair of lateral locking ears which can be compressed transversely toward one another, inserted into a suitable receptacle on the free strap end and then released to expand transversely inside the receptacle for releasable locking therein. In still another preferred embodiment, the outer end of the sliding member includes an upright shoulder and the inner end includes a finger tab projecting outside the housing for manual operation (sliding) of the sliding member. The adjacent free strap end includes a transverse slot therethrough. To effect releasable engagement, the wearer pushes the finger tab against the bias of the spring to extend the outer end of the sliding member out of the housing and then inserts the upright shoulder in the strap slot in a hooking arrangement. The wearer then releases the finger tab and the spring bias pulls the sliding member back into the housing along with the free strap end so as to prevent disengagement of the locking shoulder from the slot.

The expansible module of the invention includes an elongated housing having spaced transverse ends each defining an access opening into the housing and a spring abutment wall. A pair of elongated sliding members is disposed in the housing in superimposed relation one above the other with each sliding member having means at its outer end for connection to one of the free strap ends and an abutment wall extending therefrom at the inner end. A pair of springs is disposed in the housing with one spring between the facing abutment walls of each sliding member and associated housing end. In this way, the sliding members can slide out of the opposite ends of the housing along the strap length against spring bias to provide strap extension in both directions during removal. Since the free ends of the watch strap are connected to the outer ends of the sliding members, the housing floats between the strap ends, that is, the housing is not connected to either strap end.

DESCRIPTION OF PREFERRED EMBODIMENTS

FIGS. 1–4 illustrate a preferred expansible clasp of the invention as including a sheet metal housing 2 elongated in the direction of the longitudinal axis of the strap 4. The housing 2 comprises top and bottom walls 2*a* and 2*b* connected laterally by side walls 2*c* and 2*d*. Transverse walls 2*e* and 2*f* may be provided at opposite ends with end wall 2*e* defining a transversely elongated opening 2*g* into the housing and abutment wall 2*h*, and end wall 2*f* having one of the free ends, 4*a*, of strap 4 permanently attached thereto. For example, free strap end 4*a* may include a metal end section 4*b* which is brazed to the housing end wall 2*f*. Other alternative attachment means may be associated with end wall 2*f*, however. For example, end wall 2*f* may have portions defining well-known gripping jaws which penetrate into the strap to hold it. The end wall can include one or more projecting lugs to which the free strap end can be attached in well-known fashion. Also, portions of end wall 2*f* may define a second transversely elongated opening through which free strap end 4*a* can be inserted and appropriately secured within the housing. As shown most clearly in FIG. 2, the top wall 2*a* includes a central longitudinal slot 2*i* therein for purposes described hereafter whereas bottom wall 2*b* supports the sliding member 6 within the housing.

Figure 1:
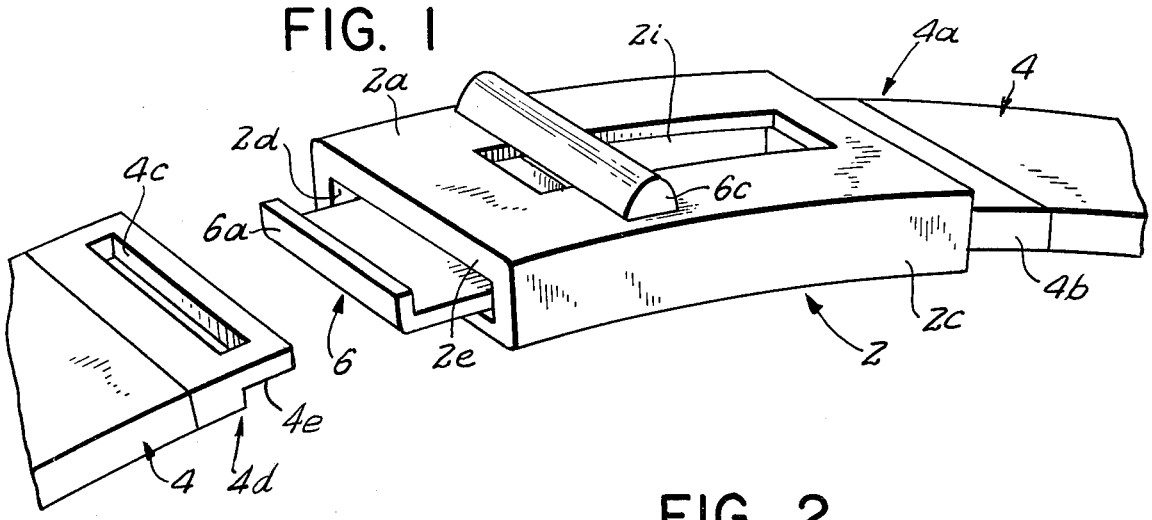
FIG. 1 is a perspective view of one expansible clasp embodiment of the invention.
Figure 2:
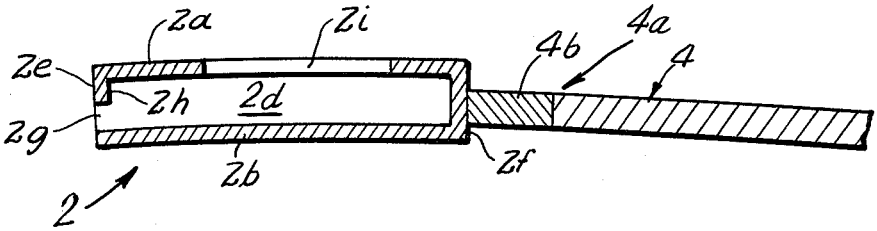
FIG. 2 is a cross-sectional view along the length of the clasp housing of FIG. 1.
Figure 3:
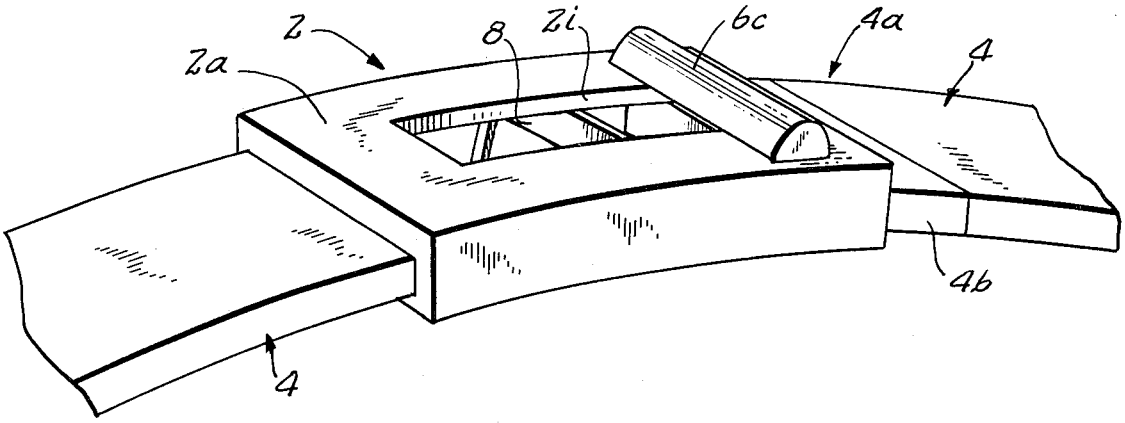
FIG. 3 is a perspective view of the expansible clasp of FIG. 1 after releasable engagement is effected.
Figure 4:
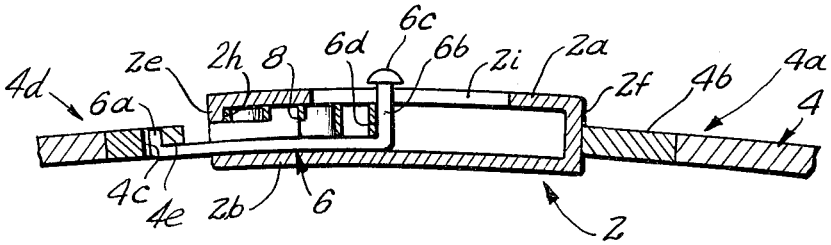
FIG. 4 is a cross-sectional view along the length of the clasp.

Sliding member 6 comprises a plate-like member having an outer end with an upturned shoulder 6*a* to function as a catch and an inner end with an upturned shoulder 6*b* terminating in a finger tab 6*c* above the top wall 2*a* of the housing, shoulder 6*b* extending through the elongated slot 2*i* in the top wall. FIG. 4 shows the shoulder 6*a* engaged in transverse slot 4*c* in the other free strap end 4*d* to effect releasable engagement therewith. The slot 4*c* may be provided in a metallic endpiece attached to the free strap end or in the strap end itself. Also shown is a Z-shaped spring 8 positioned between the abutment wall 2*h* of the housing end wall 2*e* and abutment wall 6*d* of upturned shoulder 6*b* of the sliding member. It is apparent that the abutment walls 2*h* and 6*d* are in spaced, facing relation to one another with spring 8 positioned therebetween. Spring 8 is biased so as to pull sliding member 6 into the housing 2 through access opening 2*g*. As shown in FIGS. 1–4, housing 2, sliding member 6 and spring 8 may be slightly accurate so as to conform to the wearer's wrist.

In order to initially engage shoulder 6*a* in the slot 4*c* of the adjacent free strap end, the wearer simply slides the finger tab 6*c* toward the strap end to extend the sliding member out of the housing. After the shoulder is inserted in the slot, the finger tab is released and the spring 8 pulls the sliding member and strap end 4*c* into the housing to prevent disengagement, FIG. 3. The free strap end 4*d* includes a recessed shoulder 4*e* on the bottom to accommodate sliding member 6 thereunder so that the hooked ends of the strap and sliding member can slide into the housing through the access opening. The spring 8 includes a shortened outer end (adjacent end abutment wall 2*h*) to allow room for the aforementioned hooked ends to fit in the housing; see FIG. 4. When the wearer of the watch desires to remove the wristwatch, there is no need to unhook the ends of the strap and sliding member. The strap can be simply slid over the wearer's wrist and hand with the clasp of the invention providing sufficient extension along the length of the strap by compression of spring 8 as the strap elongates.

Figure 5:
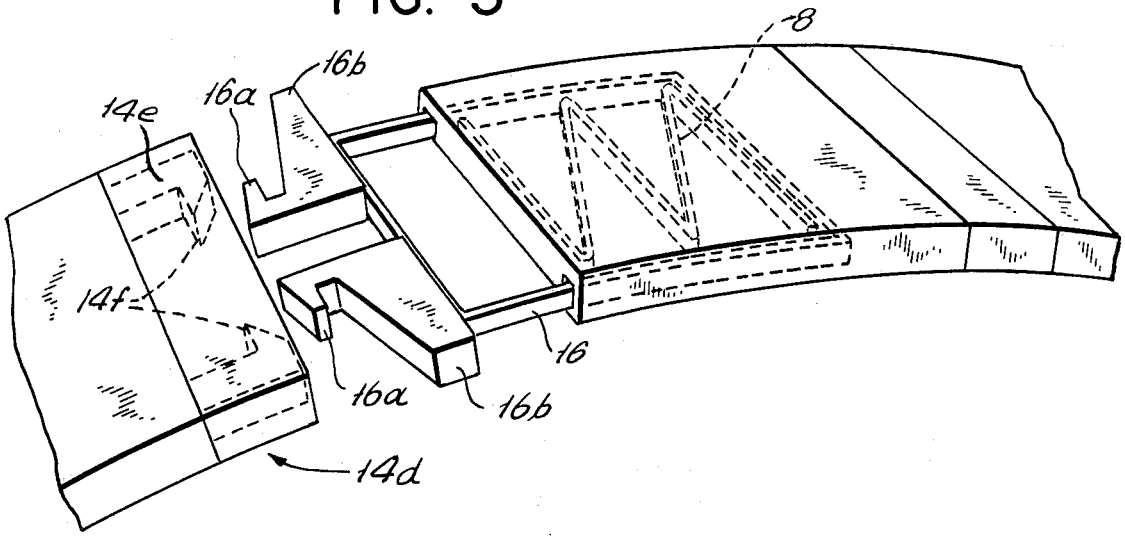
FIG. 5 is a perspective view of a second expansible clasp embodiment.
Figure 6:
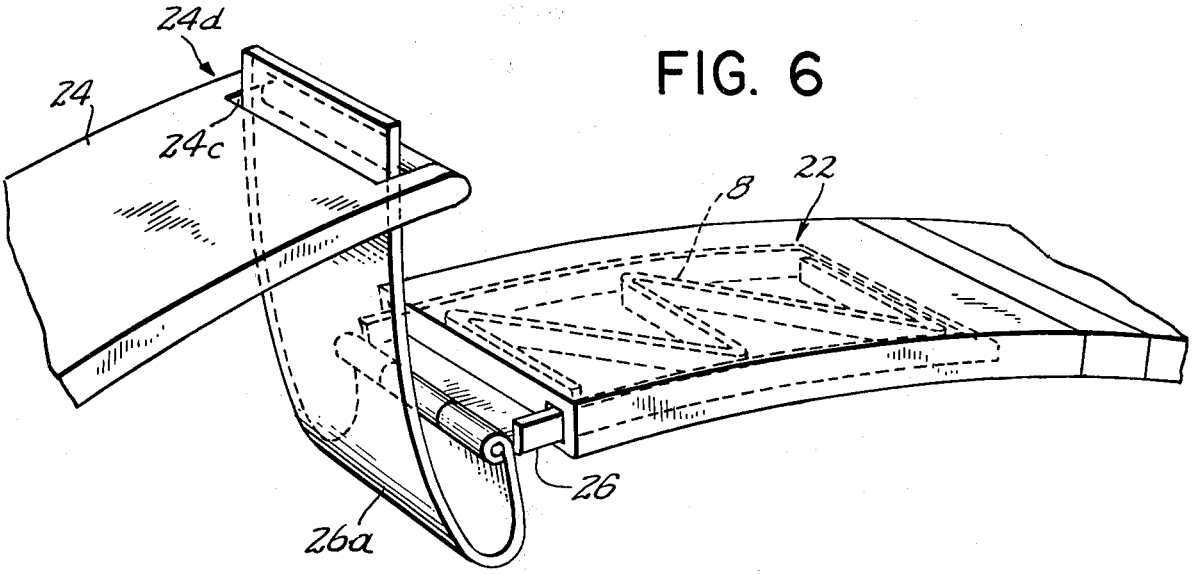
FIG. 6 is a perspective view of a third expansible clasp embodiment.

FIGS. 5 and 6 show other preferred expansible clasp constructions of the invention. These embodiments differ from that described above primarily in the means employed at the outer end of the sliding member to connect to the adjacent free strap end. In FIG. 5, the outer end of sliding member carries a pair of transversely facing locking ears 16*a* each connected to its own transversely facing push-pull tab 16*b*. The adjacent free strap end 14*d* carries an enclosure 14*e* having opposed ratchet teeth 14*f* (dotted lines) therein shaped to receive the locking ears in a ratchet type locking action. To disengage the locking ears, the wearer simply pushes the tabs 16*b* toward one another to compress the locking ears and then withdraws the locking ears from the enclosure. In FIG. 6, the outer end of the sliding member 26 carries an arcuate tongue 26*a* hinged thereto and adapted to be threaded through the slots 24*c* in free strap end 24*d* and the folded over onto and overlying housing 22. In both embodiments, the spring 8 (dotted lines) is biased so as to pull the sliding member into the housing. The other components and features of these embodiments are generally the same as those described hereinabove in relation to FIGS. 1–4.

Figure 7:
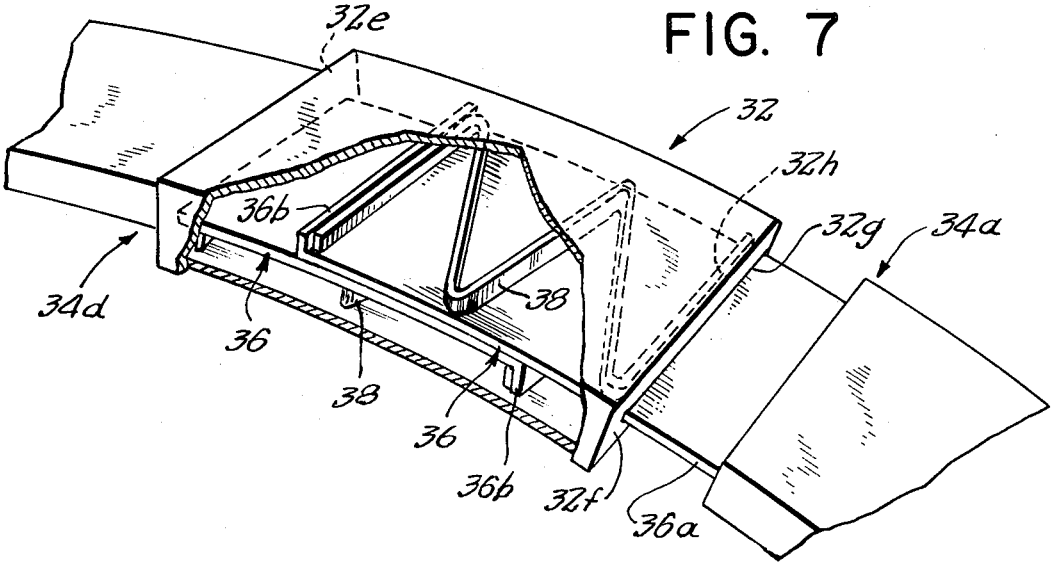
FIG. 7 is a perspective view partially broken away of a preferred expansible module of the invention.

A preferred expansible module construction for use with a watch strap is shown in FIG. 7. The module includes a pair of sliding members 36 in superimposed relation within elongated housing 32. The outer end 36*a* of each sliding member is permanently attached to the adjacent free strap end, e.g., 34*a* and 34*d* whereas the inner end of each includes a projecting shoulder 36*b* providing an abutment wall, the shoulders projecting in opposite directions as shown in the figure. As in the above illustrated embodiments, the housing has transverse end walls 32*e* and 32*f*. However, each end wall defines a transversely elongated access opening 32*g* through which the sliding member passes during expansion. Further each end wall defines an abutment wall 32*h* facing the abutment wall at the inner end of the sliding member passing therethrough. The housing 32 floats between the free strap ends 34*a* and 34*d* in that it is not secured to either strap end or to the sliding members. A pair of flat, Z-shaped springs 38 is positioned within the housing with one spring being disposed between the abutment wall of each sliding member and associated facing housing end wall. It will be apparent that this module construction allows expansion of the sliding members 36 in both (opposite) directions along the length of the strap when the strap is passed over the wrist and hand of the wearer. Of course, this feature greatly facilitates removal of the strap.

While the invention has been explained with respect to certain specific embodiments thereof, it will be understood that various other modifications and substitutions may be made without departing from the scope of the present invention.

We claim:

1. An expansible clasp for connecting the free ends of an elongated strap together, comprising:

(a) a housing elongated in the long direction of said strap, the housing having top and bottom walls connected together by spaced lateral side walls and having spaced ends transversed to the snap length, one of said ends defining an excess opening into the housing and an abutment wall and the other end being connected to one of the free strap ends, said top housing wall having a slot therethrough elongated along the strap length, (b) an elongated sliding member disposed in the housing and adapted to slide into and out of the housing through said access opening for expansion purposes, said sliding member having means at the outer end adjacent said access opening for releasably connecting to the other free strap end and having at its opposite inner end an upturned shoulder extending through the elongated slot in the top wall of said housing with portions of said shoulder inside said housing forming an abutment wall in spaced, facing relation to the abutment wall of said housing end and portions terminating outside the housing forming a finger tab by which the sliding member can be manually slid out of the housing by the wearer to effect releasable engagement between the outer end of said sliding member and said other free strap end, and (c) spring means positioned in the housing between the spaced, facing abutment walls of said sliding member and housing end, the spring means being biased so as to urge the sliding member into the housing while permitting extension thereof out of said housing for expansion and engagement purposes.

2. The clasp of claim 1 wherein the outer end of said sliding member includes an upturned catch adapted to be inserted in a slot in said other free strap end, said catch after engagement in said slot being pulled inside the housing by action of said spring means to prevent disengagement.

3. The clasp of claim 2 wherein the access opening into the housing is transversely elongated and the sliding member is a plate-like member having a transversely elongated cross-section adapted to pass through said access opening, said catch at the outer end comprising a transverse shoulder extending upwardly therefrom.

* * * * *